US011285720B2

(12) United States Patent
Sugiura et al.

(10) Patent No.: US 11,285,720 B2
(45) Date of Patent: Mar. 29, 2022

(54) LIQUID DISCHARGING HEAD

(71) Applicant: BROTHER KOGYO KABUSHIKI KAISHA, Nagoya (JP)

(72) Inventors: Keita Sugiura, Toyokawa (JP); Jiro Yamamoto, Nagoya (JP); Shotaro Kanzaki, Handa (JP); Taisuke Mizuno, Yokkaichi (JP); Hiroshi Katayama, Toyoake (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 6 days.

(21) Appl. No.: 17/032,177

(22) Filed: Sep. 25, 2020

(65) Prior Publication Data

US 2021/0138787 A1 May 13, 2021

(30) Foreign Application Priority Data

Nov. 11, 2019 (JP) ..... JP2019-204188

(51) Int. Cl.
*B41J 2/14* (2006.01)

(52) U.S. Cl.
CPC ..... *B41J 2/14145* (2013.01); *B41J 2/14201* (2013.01)

(58) Field of Classification Search
CPC ..... B41J 2/14145; B41J 2/14201; B41J 2002/14419; B41J 2/14233; B41J 2202/12
See application file for complete search history.

(56) References Cited

U.S. PATENT DOCUMENTS 9,205,657 B2 * 12/2015 Hirabayashi ..... B41J 2/155
2014/0292954 A1 10/2014 Hirabayashi et al.

FOREIGN PATENT DOCUMENTS

JP 2014-188837 A 10/2014

OTHER PUBLICATIONS

IP.com search (Year: 2021).*

* cited by examiner

*Primary Examiner* — Lisa Solomon
(74) *Attorney, Agent, or Firm* — Merchant & Gould P.C.

(57) ABSTRACT

A liquid discharging head includes: a pressure chamber; a descender extending from the pressure chamber in a first direction; a communicating channel extending from the descender in a second direction crossing the first direction; a first return channel and a second return channel connecting the communicating channel and a return manifold; and a nozzle connected to the communicating channel. The first return channel and the second return channel are connected, with respect to the communicating channel, at facing positions, respectively, the facing positions facing each other in a direction orthogonal to the second direction; and the nozzle is provided, in the communicating channel, at a position which is offset from an axis of the descender, and which is sandwiched between a connecting location of the first return channel with respect the communicating channel and a connecting location of the second return channel with respect to the communicating channel.

10 Claims, 5 Drawing Sheets

LIQUID DISCHARGING HEAD

CROSS REFERENCE TO RELATED APPLICATION

The present application claims priority from Japanese Patent Application No. 2019-204188, filed on Nov. 11, 2019, the disclosure of which is incorporated herein by reference in its entirety.

BACKGROUND

Field of the Invention

The present disclosure relates to a liquid discharging head.

Description of the Related Art

Conventionally, there is known a liquid discharging head including a nozzle, a pressure chamber, a nozzle communicating channel connected to the nozzle and the pressure chamber, and circulation individual channels each of which is connected to the nozzle communicating channel and a circulation common channel.

SUMMARY

In the above-described liquid discharging head, in a case that the liquid flows from the nozzle communicating channel to the circulation common channel, the liquid flows via the circulation individual channels. Therefore, the flow of the liquid is made uniform or uniformized in the nozzle communicating channel and the nozzle, and a path of the liquid discharged from the nozzle is prevented from deviating from a desired direction.

However, in the above-described liquid discharging head, the pressure applied to the pressure chamber is applied to the nozzle via the nozzle communicating channel. Accordingly, if the pressure is applied to the pressure chamber in a state that an air bubble enters from an opening of the nozzle (nozzle opening) into the nozzle, the air bubble is pushed to the nozzle by such pressure and remains in the nozzle. In this case, the nozzle opening might be blocked or closed by the air bubble, and/or the pressure might be absorbed by the air bubble adhered to a wall surface of the nozzle, and the liquid might not be discharged from the nozzle.

The present disclosure has been made to solve the above-mentioned problem, and an object of the present disclosure is to provide a liquid discharging head capable of suppressing an occurrence of any unsatisfactory discharge (defective discharge).

According to an aspect of the present disclosure, there is provided a liquid discharging head including: a pressure chamber; a descender extending from the pressure chamber in a first direction; a communicating channel extending from the descender in a second direction crossing the first direction; a first return channel and a second return channel connecting the communicating channel and a return manifold; and a nozzle connected to the communicating channel, wherein the first return channel and the second return channel are connected to the communicating channel, at facing positions, respectively, the facing positions facing each other in a direction orthogonal to the second direction; and the nozzle is provided, in the communicating channel, at a position which is offset from an axis of the descender and which is sandwiched between a connecting location of the first return channel to the communicating channel and a connecting location of the second return channel to the communicating channel.

According to this configuration, since the liquid flows through the first and second return channels, the flow from the communicating channel to the return manifold is dispersed. Accordingly, in a nozzle provided at the position sandwiched between the connecting location of the first return channel to the communicating channel and the connecting location of the second return channel to the communicating channel, the flow of the liquid is made uniform, thereby making it possible to suppress any deviation, in the discharging direction of the liquid, with respect to the desired direction.

Further, the pressure applied to the pressure chamber changes the direction thereof from the first direction to the second direction as the pressure propagates to the communicating channel through the descender. Thus, even if any air bubble enters into the nozzle, a force pushing the air bubble into the nozzle is reduced. As a result, it is possible to suppress the occurrence of such a situation that the air bubble remains in the nozzle, and to suppress any unsatisfactory discharge such as discharge failure due to the air bubble, etc.

DESCRIPTION OF THE EMBODIMENTS

Figure 1:
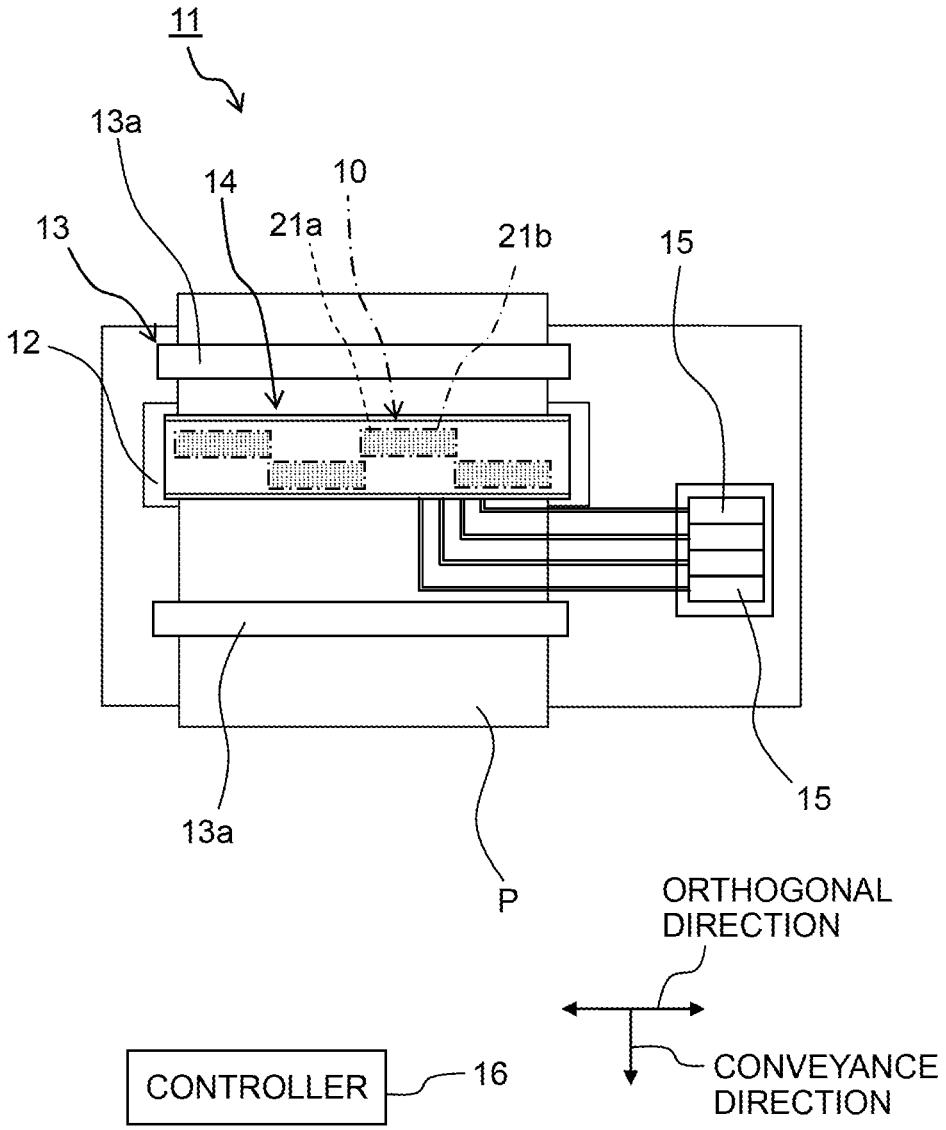
FIG. 1 is a view schematically depicting a liquid discharging apparatus provided with a liquid discharging head according to an embodiment of the present disclosure.

In the following, an embodiment of the present disclosure will be described in detail, with reference to the drawings. Note that in the following description, same reference numerals are affixed to same or corresponding elements throughout all the drawings, and any overlapping explanation therefor will be omitted.

<Configuration of Liquid Discharging Apparatus>

A liquid discharging apparatus 11 is provided with a liquid discharging head (hereinafter referred to as a "head") 10 according to an embodiment of the present disclosure. The liquid discharging apparatus 11 is an apparatus which discharges or ejects a liquid such as an ink, etc., as depicted in FIG. 1. In the following, an explanation will be given about an example wherein the liquid discharging apparatus 11 is applied to an ink-jet printer which discharges or ejects a liquid with respect to a recording medium P so as to form an image. The liquid discharging apparatus 11, however, is not limited to this. Further, a sheet material such as paper, cloth, etc., can be used as the recording medium P.

The liquid discharging apparatus 11 adopts a line head system. The liquid discharging apparatus 11 is provided with: a platen 12, a conveying part 13, a head unit 14, a storing tank 15, and a controller 16. Note, however, that the liquid discharging apparatus 11 is not limited to or restricted by the line head system, and the liquid discharging apparatus 11 may adopt another system such as a serial head system, etc.

The platen 12 is a flat plate member. The recording medium P is placed on the upper surface of the platen 12.

The conveying part 13 has, for example, two conveying rollers 13*a*, and a conveying motor. The two conveying rollers 13*a* are arranged parallel to each other so as to sandwich the platen 12 therebetween in a conveyance direction. The two conveying rollers 13*a* are connected to the conveying motor. In a case that the conveying motor is driven, the conveying rollers 13*a* rotate and the recording medium P on the platen 12 is conveyed in the conveyance direction.

The head unit 14 extends to be long in a direction (orthogonal direction) orthogonal to the conveyance direction. In the orthogonal direction, the length of the head unit 14 is not less than the length of the recording medium P. The head unit 14 is provided with a plurality of pieces of the head 10. Each of the heads 10 is provided with a discharge surface 21*a* facing the upper surface of the platen 12, and a plurality of nozzles holes 21*b* which are open in the discharge surface 21*a*. Note that the details of the head 10 will be described later on.

The storing tank 15 is provided as a plurality of storing tanks 15 for the kinds of the liquids, respectively. For example, four pieces of the storing tank 15 store black, yellow, cyan, and magenta liquids, respectively. Each of the liquids stored in one of the storing tanks 15 is supplied to the nozzle holes 21*b* of one of the heads 10 corresponding to one of the storing tanks 15, respectively. In a case that pressure is applied to the liquid inside a pressure chamber by a piezoelectric element, the liquid is discharged from the nozzle hole 21*b*, as will be described later on.

The controller 16 includes a processor such as a CPU, a memory such as a RAM and ROM, etc., a driver IC such as a ASIC, etc. In a case that the CPU receives various requests and a detecting signal of a sensor, the CPU causes the RAM to store various kinds of data and outputs various execution commands or instructions to the ASIC, based on program(s) stored in the ROM. Based on the command, the ASIC controls respective driver ICs and executes an operation corresponding to the command. This drives the piezoelectric element of the head 10 and the conveying motor of the conveying part 13.

For example, the controller 16 executes a discharging operation of discharging or ejecting the liquid from the nozzle holes 21*a* of the head 10 and a conveying operation of conveying, by the conveying part 13, the recording medium P in the conveying direction by a predetermined amount. With this, a printing processing of forming an image on the recording medium P is executed.

<Configuration of Head>

Figure 2:
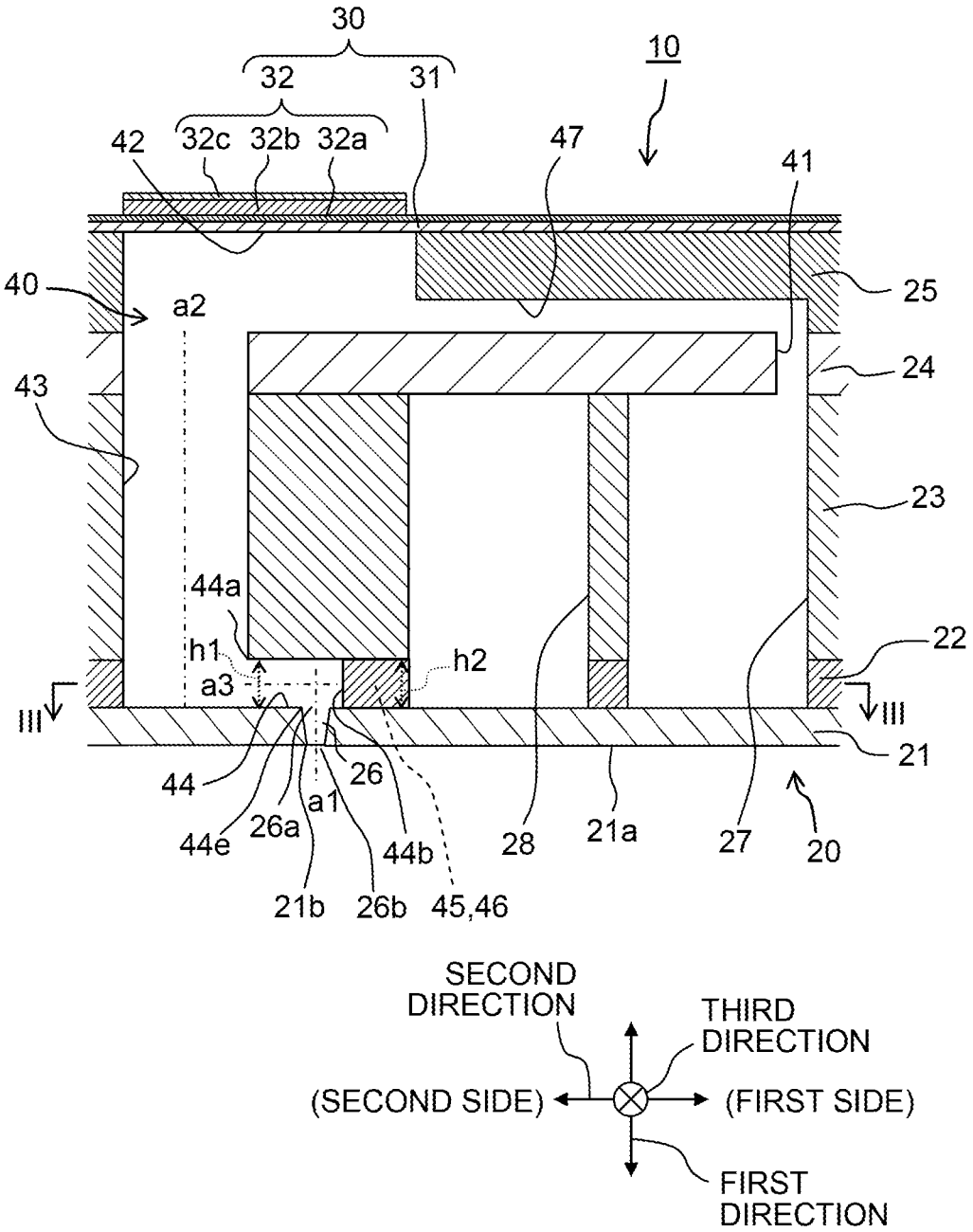
FIG. 2 is a cross-sectional view of the liquid discharging head of FIG. 1, taken along a cross section orthogonal to a third direction.
Figure 3:
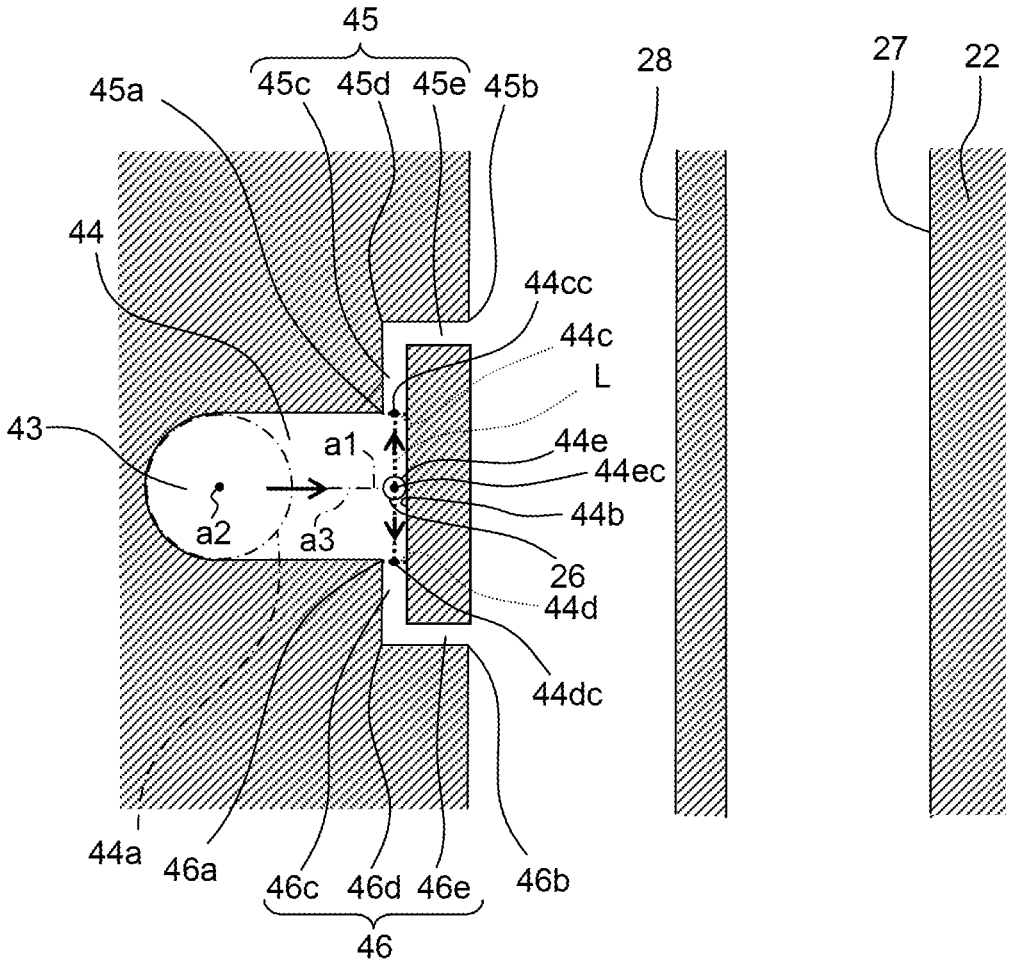
FIG. 3 is a partial cross-sectional view of the liquid discharging head, taken along a line III-III of FIG. 2.
Figure 3:
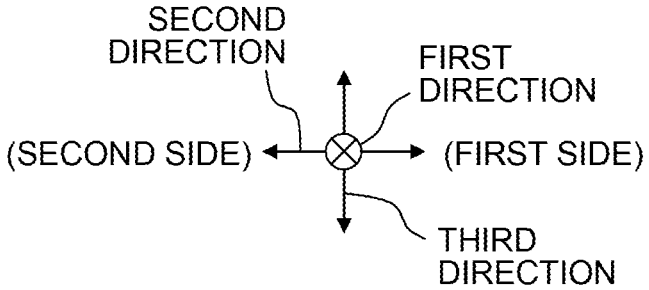

The head 10 includes a channel forming body 20, and a volume changing part 30, as depicted in FIGS. 2 and 3. A liquid channel is formed in the inside of the channel forming body 20. The channel forming body 20 is constructed as a stacked body (laminated body) of a nozzle plate 21, a first channel plate 22, a second channel plate 23, a third channel plate 24, and a fourth channel plate 25. These plates are stacked in a first direction in this order and are bonded to one another with an adhesive, etc.

Note that the number of the plates is not limited to this, and may be larger or smaller than this. In the following, a side on which the nozzle plate 21 is arranged with respect to the first channel plate 22 in the first direction is referred to as a "lower side", and an opposite side thereto is referred to as an "upper side". However, the arrangement of the head 10 is not limited to this.

Each of the plates is flat plate-shaped, and each of the plates is formed with holes and grooves of various sizes. In the channel forming body 20 in which the plates are stacked, the holes and the grooves are combined to thereby form, for example, a plurality of nozzles 26, a plurality of individual channels 40, a supplying manifold 27 and a return manifold 28, as the liquid channel.

The plurality of nozzles 26 penetrate through the nozzle plate 21 in the first direction. The plurality of nozzles holes 21*b* are formed in the lower surface (discharge surface 21*a*) of the nozzle plate 21. A plurality of nozzle holes 21*b* form a plurality of nozzle hole rows arranged side by side in a second direction. Each of the plurality of nozzle hole rows extends in a third direction.

Note that the second direction is a direction crossing the first direction (for example, a direction orthogonal to the first direction), and the third direction is a direction crossing the first direction and the second direction (for example, a direction orthogonal to the first direction and the second direction). Further, a direction in which the nozzles holes 21*b* are aligned may be along the orthogonal direction of FIG. 1, or may be inclined with respect to the orthogonal direction. Further, a direction in which the nozzles hole rows are arranged side by side may be along the conveyance direction, or may be inclined with respect to the conveyance direction.

Each of the nozzles 26 has, in the first direction, a proximal end 26*a* and a distal end 26*b* which is on an opposite side to the proximal end 26*a*. The nozzle hole 21*b* is formed in the discharge surface 21*a* by the distal end 26*b* of the nozzle 26. An axis a1 of the nozzle 26 passes through the center of the proximal end 26*a* and the center of the distal end 26*b*, and extends in the first direction. The nozzle 26 has a tapered shape in which the cross-sectional area orthogonal to the axial direction (first direction) of the nozzle 26 is continuously reduced from the proximal end 26*a* toward the distal end 26*b*. The nozzle 26 has, for example, a conical shape such as a truncated conical shape, etc.

Each of the supply manifold 27 and the return manifold 28 is elongated or extends in the third direction and is connected to the plurality of individual channels 40. The plurality of individual channels 40, the return manifold 28 and the supply manifold 27 are arranged in this order in the second direction. Note that in the second direction, the side on which the supply manifold 27 is arranged with respect to the return manifold 28 is referred to as a "first side", and the side opposite to this side is referred to as a "second side". Further, the arrangement of the return manifold 28 and the supply manifold 27 is not limited to this. For example, the individual channel 40 may be arranged between the supply manifold 27 and the return manifold 28 in the second direction. Further, in the first direction, the supply manifold 27 may be stacked on the return manifold 28.

A supply port is provided on the supply manifold 27, at on one end in the longitudinal direction of the supply manifold 27. A return port is provided on the return manifold 28, at on one end in the longitudinal direction of the return manifold 28. The supply port and the return port are connected to a sub tank provided in the head 10. The sub tank is connected to one of the storing tanks 15 (FIG. 1) corresponding thereto, and the liquid is supplied from the storing tank 15 to the sub tank.

A cross-sectional area orthogonal to the third direction (third cross-sectional area) of the supply manifold 27, and a cross-sectional area orthogonal to the third direction (third cross-sectional area) of the return manifold 28 are same as each other. For example, a cross-sectional area orthogonal to the first direction (first cross-sectional area) of each of the supply manifold 27 and the return manifold 28 is in a range of not less than 0.01 $mm^2$ and not more than 0.05 $mm^2$. A cross-sectional area orthogonal to the second direction (second cross-sectional area) of each of the supply manifold 27 and the return manifold 28 is in a range of not less than 0.1 $mm^2$ and not more than 0.5 $mm^2$. The third cross-sectional area of each of the supply manifold 27 and the return manifold 28 is in a range of not less than 0.001 $mm^2$ and not more than 0.005 $mm^2$. Each of the supply manifold 27 and the return manifold 28 is formed by through holes penetrating through the first channel plate 22 and the second channel plate 23 in the first direction. A lower end of each of the supply manifold 27 and the return manifold 28 is covered with the nozzle plate 21, and an upper end of each of the supply manifold 27 and the return manifold 28 are covered with the third channel plates 24.

The plurality of individual channels 40 branch from supply manifold 27 and are integrated into the return manifold 28. The sub tank, the supply manifold 27, the plurality of individual channels 40, the return manifold 28 and the sub tank are connected in this order so as to construct a circulation path or circulation route. Note that the supply manifold 27 and the return manifold 28 may be connected to each other via a connecting channel. In such a case, the sub tank, the supply manifold 27, the connecting channel, the return manifold 28 and the sub tank are connected in this order so as to form the circulation route.

In the following, although the construction of an individual channel 40 included in the plurality of individual channels 40 will be explained, the construction of remaining individual channels 40 included in the plurality of individual channels 40 are also same. An upstream end of the individual channel 40 is connected to the supply manifold 27, and a downstream end of the individual channel 40 is connected to the return manifold 28. Between the upstream end and downstream end of each of the plurality of individual channels 40, the individual channel 40 is connected to the proximal end 26*a* of the nozzle 26. The individual channel 40 includes a supply channel 41, a supply throttle 47, a pressure chamber 42, a descender 43, a communicating channel 44 and a plurality of return channels (for example, a first return channel 45 and a second return channel 46). The supply channel 41, the supply throttle 47, the pressure chamber 42, the descender 43, the communicating channel 44 and the plurality of return channels are arranged in this order.

The supply channel 41 penetrates through the third channel plates 24 in the first direction. A lower end of the supply channel 41 is connected to an upper end of the supply manifold 27. The supply channel 41 extends upwardly in the first direction from the supply manifold 27. The supply channel 41 is arranged closer to the first side than a central part in the second direction of the supply manifold 27. A cross-sectional area orthogonal to the first direction (first cross-sectional area) of the supply channel 41 is smaller than the third cross-sectional area of the supply manifold 27.

The supply throttle 47 is formed of a groove recessed from the lower surface of the fourth channel plate 25. A lower end of the supply throttle 47 is covered by the third channel plate 24. The supply throttle 47 extends in the second direction. A lower end on the first side of the supply throttle 47 is connected to an upper end of the supply channel 41. A cross-sectional area orthogonal to the second direction (second cross-sectional area) of the supply throttle 47 may be smaller than the third cross-sectional area of the supply manifold 27, and may be not more than the first cross-sectional area of the supply channel 41.

The pressure chamber 42 penetrates through the fourth channel plates 25 in the first direction. A lower end of the pressure chamber 42 is covered with the third channel plate 24. The pressure chamber 42 extends in the second direction. An end on the first side of the pressure chamber 42 is connected to an end on the second side of the supply throttle 47. A cross-sectional area orthogonal to the second direction (second cross-sectional area) of the pressure chamber 42 is greater than the second cross-sectional area of the supply throttle 47.

The descender 43 penetrates through the first channel plate 22 to the third channel plate 24 in the first direction. An upper end of the descender 43 is connected to a lower end on the second side of the pressure chamber 42. The descender 43 extends downward in the first direction from the pressure chamber 42. A lower end of the descender 43 is covered by the nozzle plate 21. A central axis (axis a2), of the descender 43, which passes through the center of the upper end and center of the lower end of the descender 43 extends in the first direction. The descender 43 has a columnar shape such as a cylindrical shape, etc. In the second direction, the return manifold 28 is arranged between the descender 43 and the supply manifold 27.

The communicating channel 44 penetrates through the first channel plate 22 in the first direction. An upper end of the communicating channel 44 is covered with the second channel plate 23, and a lower end of the communicating channel 44 is covered with the nozzle plate 21. The communicating channel 44 has an end 44*a* on the second side in the second direction, and an end 44*b* on the first side in the second direction. The end 44*a* on the second side of the communicating channel 44 is connected to the first side of the descender 43. The communicating channel 44 extends from the descender 43 toward the first side. A cross-sectional area (second cross-sectional area), of the communicating channel 44, which is orthogonal to the second direction is not more than the first cross-sectional area of the descender 43.

A lower end of the communicating channel 44 is connected to the lower end of the descender 43. Further, the proximal end 26*a* of the nozzle 26 is connected to the lower end of the communicating channel 44. As viewed along the first direction, the lower end of the descender 43 and the proximal end 26*a* of the nozzle 26 do not overlap with each other. Namely, the nozzle 26 is provided in the communicating channel 44 at a position which is offset from the axis a2 of the descender 43.

The center in the third direction of the communicating channel 44 is located at the center of the proximal end 26*a* of the nozzle 26. The center of the nozzle 26 is arranged on a central axis (axis a3) passing through the center of the end 44*a* on the second side and the center of the end 44*b* on the first side of the communicating channel 44. Namely, the axis a3 of the communicating channel 44 and the axis a1 of the nozzle 26 cross each other. The nozzle 26 extends from the communicating channel 44 toward the lower side in the first direction. A cross-sectional area orthogonal to the first direction (first cross-sectional area) of the nozzle 26 is smaller than the second cross-sectional area of the communicating channel 44.

The first return channel 45 and the second return channel 46 penetrate through the first channel plate 22 in the first direction. An upper end of each of the first and second return channels 45 and 46 is covered with the second channel plate 23, and a lower end of each of the first and second return channels 45 and 46 is covered with the nozzle plate 21. The first return channel 45 and the second return channel 46 connect the communicating channel 44 and the return manifold 28. Note that the details of the first return channel 45 and the second return channel 46 will be described later on.

The volume changing part 30 includes a vibration plate 31 and a piezoelectric element 32, and changes the volume of the liquid channel of the channel forming body 20. Note that the volume changing part 30 is not limited to that of the system using the piezoelectric element 32 (piezoelectric system); it is allowable that the volume changing part 30 may adopt, for example, a thermal system using a heating element or an electrostatic system using a conductive vibration plate and an electrode.

The vibration plate 31 is stacked on the fourth channel plate 25, and covers an upper end of the pressure chamber 42. Note that the vibration plate 31 may be integrally formed with the fourth channel plate 25. In such a case, the pressure chamber 42 is formed of a recessed part which is recessed upward in the first direction, from the lower surface of the fourth channel plate 25. In the fourth channel plate 25, an upper part, of the fourth channel plate 25, which is located above the pressure chamber 42 functions as the vibration plate 31.

The piezoelectric element 32 includes a common electrode 32*a*, a piezoelectric layer 32*b* and an individual electrode 32*c*. The common electrode 32*a*, the piezoelectric layer 32*b* and the individual electrode 32*c* are arranged in this order in the first direction. The common electrode 32*a* covers the entire surface of the vibration plate 31 via an insulating film. The piezoelectric layer 32*b* is provided for each of the pressure chamber 42, and is arranged on the common electrode 32*a*. The individual electrode 32*c* is provided for each of the pressure chamber 42, and is arranged on the piezoelectric layer 32*b* so as to overlap with the pressure chamber 42. One piece of the piezoelectric element 32 is constructed by one piece of the individual electrode 32*c*, the common electrode 32*a*, and a part or portion (active part), of the piezoelectric layer 32*b*, which is sandwiched by one piece of the individual electrode 32*c* and the common electrode 32*a*.

The individual electrode 32*c* is electrically connected to a driver IC. The driver IC receives a control signal from the controller 16 (FIG. 1) so as to generate a driving signal (voltage signal) and applies the driving signal to the individual electrode 32*c*. On the other hand, the common electrode 32*a* is constantly maintained at the ground potential.

Depending on the driving signal, the active part of the piezoelectric layer 32*b* expands or contracts in a plane direction, together with the two electrodes 32*a* and 32*c*. In response to this, the vibration plate 31 deforms in a direction for increasing or decreasing the volume of the pressure chamber 42. With this, a discharge pressure is applied to the liquid inside the pressure chamber 42 so as to discharge or eject the liquid from the nozzle 26.

<Flow of Liquid>

For example, the supply port of the supply manifold 27 and the sub tank are connected by a supply piping, and the return port of the manifold 28 and the sub tank are connected by a return piping. In a case that a pressure pump of the supply piping and a negative pressure pump of the return piping are driven, the liquid flows from the sub tank, flows through the supply pipe, flows into the supply manifold 27, and flows through the supply manifold 27 in the third direction.

During this time, a part of the liquid flows into the plurality of individual channels 40. The liquid flows from the supply manifold 27 into the supply channel 41 of each of the plurality of individual channels 40; the liquid flows through the supply channel 41 in the first direction; the liquid flows through the supply throttle 47 in the second direction, and the liquid further flows through the pressure chamber 42 in the second direction. Then, the liquid flows in the descender 43 in the first direction, and flows in the communicating channel 44 in the second direction. Further, in the communicating channel 44, a part of the liquid flows into the nozzle 26 and flows from the proximal end 26*a* to the distal end 26*b* in the first direction. Here, in a case that the discharge pressure is applied to the liquid inside the pressure chamber 42 by the piezoelectric element 32, a pressure wave is propagated from the pressure chamber 42 to the nozzle 26 via the descender 43 and the communicating channel 44, thereby discharging or ejecting the liquid from the nozzle hole 21*b*.

Further, the remaining part of the liquid in the communicating channel 44 flows from the communicating channel 44 and into the first return channel 45 and the second return channel 46; and the remaining part of the liquid flows in the second direction through each of the first and second return channels 45, 46 and flows into the return manifold 28. Then, the liquid flows through the return manifold 28 in the third direction, flows through the return piping, and returns to the sub tank. In such a manner, the liquid which has not been discharged from the nozzle 26 circulates between the sub tank and the individual channel 40.

<Configuration of First Return Channel and Second Return Channel>

A lower end of each of the first return channel 45 and the second return channel 46 is connected to the lower end of the communicating channel 44. An upper end of each of the first return channel 45 and the second return channel 46 is connected to the upper end of the communicating channel 44. The size in the first direction (height h2) of each of the first return channel 45 and the second return channel 46 is same as the size in the first direction (height h1) of the communicating channel 44. Each of the height h1 and the height h2 is, for example, in a range of not less than 0.01 μm and not more than 0.05 μm. Thus, in the axial direction of the nozzle 26 (first direction), it is possible to make (secure) the height h1, of the channel (the communicating channel 44) which is located closer to the pressure chamber 42 than the nozzle 26, to be great. With this, it is possible to lower any reduction in a component in the first direction of the pressure propagated from the pressure chamber 42 to the communicating channel 44 via the descender 43. This pressure is applied from the communicating channel 44 to the nozzle 26 extending in the first direction, and the liquid is discharged from the nozzle 26. Therefore, it is possible to prevent the occurrence of non-discharge of the liquid and reduction in the discharge amount due to the insufficient pressure, and to suppress the occurrence of unsatisfactory discharge.

Further, each of the first return channel 45 and the second return channel 46 has the cross-sectional area orthogonal to the direction in which the liquid flows is smaller than the second cross-sectional area of the communicating channel 44 and the third cross-sectional area of the return manifold 28. Accordingly, it is possible to reduce the occurrence of such a situation that the pressure applied to the liquid inside the pressure chamber 42 escapes from the communicating channel 44 to the return manifold 28 via each of the first and second return channels 45 and 46. Therefore, it is possible to suppress the occurrence of the unsatisfactory discharge.

The first return channel 45 has a first upstream end 45*a* in the direction in which the liquid flows, and a first downstream end 45*b* which is on the opposite side to the first upstream end 45*a*. The first upstream end 45*a* is connected to the first side of the communicating channel 44, and the first downstream end 45*b* is connected to the second side of the return manifold 28. The second return channel 46 has a second upstream end 46*a* in the direction in which the liquid flows, and a second downstream end 46*b* which is on the opposite side to the second upstream end 46*a*. The second upstream end 46*a* is connected to the first side of the communicating channel 44, and the second downstream end 46*b* is connected to the second side of the return manifold 28.

The first upstream end 45*a* of the first return channel 45 is connected to one side in the third direction of the communicating channel 44, and the second upstream end 46*a* of the second return channel 46 is connected to the other side in the third direction of the communicating channel 44. A length in the second direction from the descender 43 to the first upstream end 45*a* and a length in the second direction from the descender 43 to the second upstream end 46*a* are same as each other. The first upstream end 45*a* and the second upstream end 46*a* are opposed to each other (face each other) in the third direction, with the communicating channel 44 sandwiched therebetween. Namely, the first return channel 45 and the second return channel 46 are connected at facing positions which are in the communicating channel 44 and which face each other in the third direction.

The nozzle 26 is arranged between a connection location at which the first return channel 45 is connected to the communicating channel 44 and a connection location at which the second return channel 46 is connected to the communicating channel 44. In other words, the nozzle 26 is arranged between the first upstream end 45*a* of the first return channel 45 and the second upstream end 46*a* of the second return channel 46. In the second direction, a position of an end on the first side of the nozzle 26 is same as a position of an end on the first side of each of the first and second upstream ends 45*a* and 46*a*, is same as a position of an end on the second side of each of the first and second upstream ends 45*a* and 46, or is a position between the end on the first side of each of the first and second upstream ends 45*a* and 46*a* and the end on the second side of each of the first and second upstream ends 45*a* and 46*a*. Alternatively, a position of an end on the second side of the nozzle 26 is same as the position of the end on the first side of each of the first and second upstream ends 45*a* and 46*a*, is same as the position of the end on the second side of each of the first and second upstream ends 45*a* and 46, or is the position between the end on the first side of each of the first and second upstream ends 45*a* and 46 and the end on the second side of each of the first and second upstream ends 45*a* and 46. Further, the nozzle 26 is provided, in the communicating channel 44, at a position which is offset from the axis a2 of the descender 43.

According to this, the liquid flows from the communicating channel 44 to the first return channel 45 and the second return channel 46, thereby dispersing the flow from the communicating channel 44 to the return manifold 28. Therefore, the flow of the liquid in the nozzle 26 is made to be uniform, thereby making it possible to suppress the occurrence of any deviation in the discharge direction of the liquid with respect to the desired direction. Further, in a case that the pressure applied to the liquid inside the pressure chamber 42 propagates from the pressure chamber 42 to the communicating channel 44 via the descender 43, the pressure changes direction thereof from the first direction to the second direction. Accordingly, even if the any air bubble enters into the nozzle 26, a force of pushing the air bubbles to the nozzle 26 is reduced. As a result, it is possible to reduce such a situation that the air bubble remains in the nozzle 26, and to suppress any unsatisfactory discharge caused by the air bubble.

Here, the nozzle 26 has the tapered shape in which the cross-sectional area orthogonal to the axial direction is reduced from the proximal end 26*a* toward the distal end 26*b*. In the nozzle 26 having such a tapered shape with the reduced diameter, the air bubble is likely to remain in the nozzle 26. However, in the present embodiment, since the nozzle 26 is connected to the communicating channel 44, it is possible to reduce the remaining or stagnation of the air bubble in the nozzle 26.

The first upstream end 45*a* of the first return channel 45 and the second upstream end 46*a* of the second return channel 46 are connected to the end 44*b* on the first side of the communicating channel 44. Further, the second downstream end 45*b* of the first return channel 45 and the second downstream end 46*b* of the second return channel 46 are connected to the second side of the return manifold 28. Here, since the end on the first side of each of the first and second upstream ends 45 and 46 and the end 44*b* on the first side of the communicating channel 44 are joined, the first return channel 45 and the second return channel 46 continuously extend from the end 44*b* on the first side of the communicating channel 44, without any step or stepped part.

With this, the liquid flows from the end 44*a* on the second side to the end 44*b* on the first side of the communicating channel 44. The flow of the liquid makes contact with the end 44*b* on the first side, which in turn reduces a component in the second direction. Further, the flow of the liquid branches into the first return channel 45 and the second return channel 46 at the end 44*b* on the first side. Accordingly, in the flow of the liquid, a component toward the first return channel 45 (toward one side in the third direction) and a component toward the second return channel 46 (toward the other side in the third direction) cancel each other out. With this, the uniformity of the flow of the liquid is improved in the nozzle 26 sandwiched between the first return channel 45 and the second return channel 46, thereby making it possible to suppress any deviation in the discharge direction with respect to the desired direction.

The communicating channel 44 has a connecting location (first connection port 44*c*) with respect the first return channel 45, a connecting location (second connection port 44*d*) with respect to the second return channel 46, and a connecting location (third connection port 44*e*) with respect to the nozzle 26. The first upstream end 45*a* of the first return channel 45 is connected to the first connection port 44*c*, and the communicating channel 44 communicates with the first return channel 45. The second upstream end 46*a* of the second return channel 46 is connected to the second connection port 44*d*, and the communicating channel 44 communicates with the second return channel 46. The proximal end 26*a* of the nozzle 26 is connected to the third connection port 44*e*, and the communicating channel 44 communicates with the nozzle 26. A center 44*ec* of the third connection port 44*e* is on the axis a1 of the nozzle 26, and is arranged on a line segment L connecting a center 44*ec* of the first connection port 44*c* and a center 44*dc* of the second connection port 44*d*.

According to this, in the flow of the liquid, a component from the communicating channel 44 toward one side in the third direction and a component from the communicating channel 44 toward the other side in the third direction cancel each other out on the line segment L. By arranging the center of the nozzle 26 at such a position, it is possible to further uniformize the flow of the liquid in the nozzle 26, thereby making it possible to further suppress the deviation in the discharge direction of the liquid from the nozzle 26.

Each of the first return channel 45 and the second return channel 46 is bent along a plane or surface orthogonal to the first direction. For example, the first return channel 45 has a first upstream part 45*c* which extends linearly from the first upstream end 45*a* to one side in the third direction, a first bent part 45*d* which is bent from the first upstream part 45*c* in the second direction, and a first downstream part 45*e* which extends linearly from the first bent part 45*d* to the first side in the second direction. Namely, the first return channel 45 is bent from the third direction to the second direction. The second return channel 46 has a second upstream part 46*c* which extends linearly from the second upstream end 46*a* to the other side in the third direction, a second bent part 46*d* which is bent in the second direction from the second upstream part 46*c*, and a second downstream part 46*e* extending linearly from the second bent part 46*d* to the first side in the second direction. Namely, the second return channel 46 is also bent from the third direction to the second direction.

According to this, it is possible to suppress any spread of each of the first and second return channels 45 and 46 in the second direction and the third direction, without shortening the length of each of the first return channel 45 and the second return channel 46. Thus, it is possible to suppress any increase in the size of the head 10, while suppressing the occurrence of unsatisfactory discharge which is caused due to such a situation that the pressure applied to the liquid inside the pressure chamber 42 escapes through the respective first and second return channels 45 and 46. Further, since the angle of each of the first and second bent parts 45*d* and 46*d* is 90 degrees, it is possible to easily form each of the first and second return channels 45 and 46.

The first return channel 45 and the second return channel 46 have shapes symmetrical with respect to the axis a3 of the communicating channel 44 extending in the second direction. For example, the first upstream part 45*c* and the second upstream part 46*c* extend, in the third direction, from the communicating channel 44 in mutually opposite sides, respectively. Further, the first upstream part 45*c* and the second upstream part 46*c* have lengths thereof in the third direction and cross-sectional areas thereof orthogonal to the third direction which are same as each other. The first downstream part 45*e* and the second downstream part 46*e* sandwich the communicating channel 44 therebetween and extend in the second direction. Furthermore, the first downstream part 45*e* and the second downstream part 46*e* have lengths thereof in the second direction and cross-sectional areas thereof orthogonal to the second direction which are same as each other. According to this, the flow amount of the liquid flowing from the communicating channel 44 to the first return channel 45 and the flow amount of the liquid flowing from the communicating channel 44 to the second return channel 46 are uniformized, thereby making it possible to uniformize the flow of the liquid in the nozzle 26, and to suppress the deviation in the discharging direction.

The channel resistance of the first return channel 45 and the channel resistance of the second return channel 46 are same as each other. For example, the cross-sectional area and the length of the first return channel 45 are same as the cross-sectional area and the length of the second return channel 46, respectively. The angles of the first upstream part 45*c* of the first return channel 45 and the second upstream part 46*c* of the second return channel 46 with respect to the communicating channel 44 are same as each other, and the angles of the first downstream part 45*e* of the first return channel 45 and the second downstream part 46*e* of the second return channel 46 with respect to the return manifold 28 are both 90 degrees. According to this, since the flow amount of the liquid flowing from the communicating channel 44 to the first return channel 45 and the flow amount of the liquid flowing from the communicating channel 44 to the second return channel 46 are uniformized, the flow of the liquid in the nozzle 26 is uniformized, thereby making it possible to suppress the deviation in the discharging direction. Note that in a case that the channel resistance of the first return channel 45 and the channel resistance of the second return channel 46 are same, it is allowable that the cross-sectional area, length, and angle with respect to the communicating channel 44 of the first return channel 45 are made different from the cross-sectional area, length, and angle with respect to the communicating channel 44 of the second return channel 46, respectively.

<First Modification>

Figure 4A:
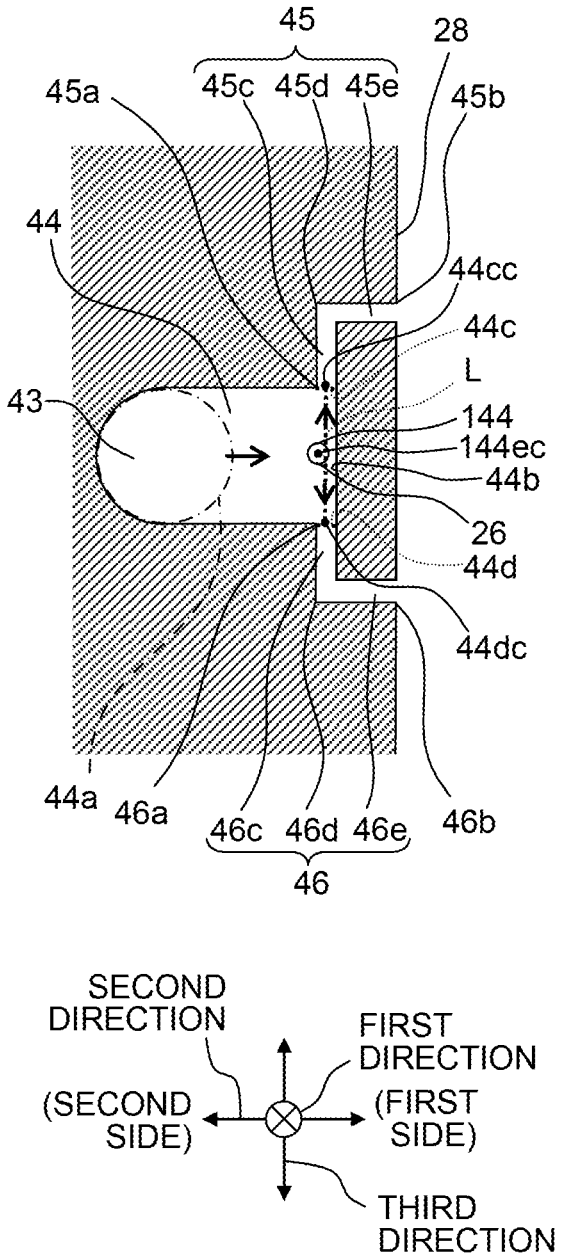
FIG. 4A is a partial cross-sectional view of a liquid discharging head according to a first modification.

In a head 10 according to a first modification, as depicted in FIG. 4A, a third connection port 144*e* is arranged on a line segment L connecting a center 44*cc* of a first connection port 44*c* and a center 44*dc* of a second connection port 44*d*. However, a center 144*ec* of the third connection port 144*e* is shifted from the line segment L in the second direction, and a gap is defined between the center 144*ec* and the line segment L. Note that other than this point, the third connection port 144*e* is similar to the third connection port 44*e*.

In the second direction, the line segment L is arranged between the center 144*ec* and the end on the second side of the third connection port 144*e*, or the line segment L is arranged between the center 144*ec* and the end on the first side of the third connection port 144*e*. Further, in the second direction, the center 144*ec* of the third connection port 144*e* may be on the first side relative to the line segment L, or may be on the second side relative to the line segment L. Even in such a case, in the flow of the liquid, a component from the communicating channel 44 toward the first return channel 45 and a component from the communicating channel 44 toward the second return channel 46 cancel each other out. With this, the flow of the liquid in the nozzle 26 is uniformized, thereby making it possible to suppress the deviation in the discharging direction.

<Second Modification>

Figure 4B:
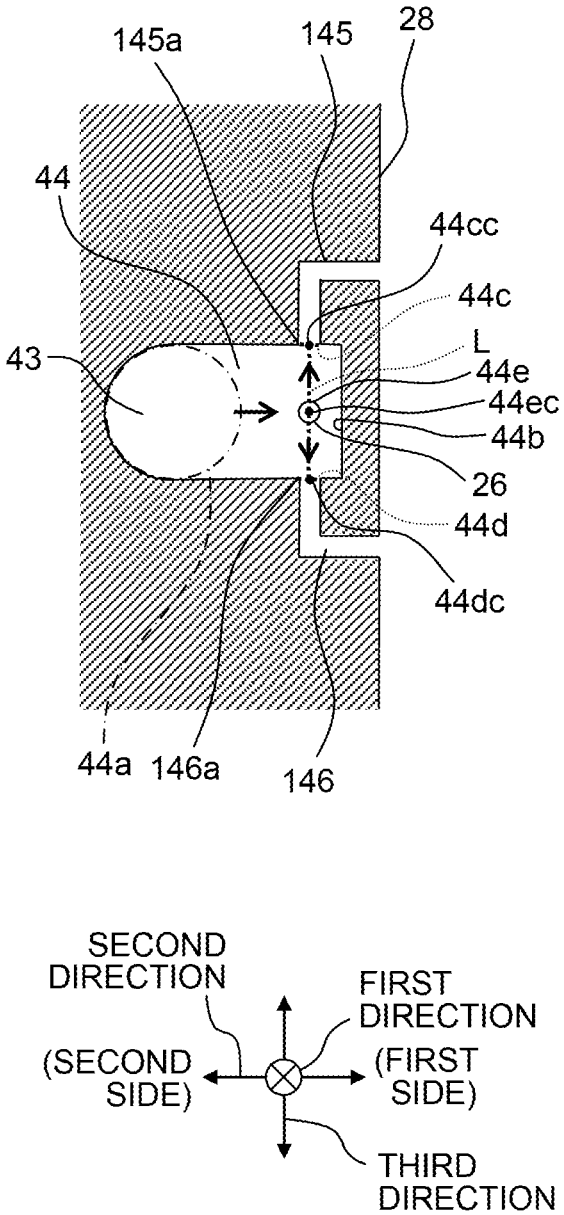
FIG. 4B is a partial cross-sectional view of a liquid discharging head according to a second modification.

In a head 10 according to a second modification, as depicted in FIG. 4B, a first return channel 145 and a second return channel 146 are connected to locations, of the communicating channel 44, which are closer to the second side in the second direction than the end 44*b* on the first side of the communicating channel 44. Note that other than this point, the first return channel 145 and the second return channel 146 are similar to the first return channel 45 and the second return channel 46, respectively.

The first return channel 145 and the second return channel 146 are connected, in the second direction, between an end 44*b* on the first side and an end 44*a* on the second side of the communicating channel 44. At an upstream end 145*a* of the first return channel 145, an end on the second side thereof in the second direction is located on the first side with respect to the end 44*a* on the second side of the communicating channel 44, and an end on the first side thereof in the second direction is located on the second side with respect to the end 44*b* on the first side of the communicating channel 44. Similarly, at an upstream end 146*a* of the second return channel 146, an end on the second side thereof in the second direction is located on the first side with respect to the end 44*a* on the second side of the communicating channel 44, and an end on the first side thereof in the second direction is located on the second side with respect to the end 44*b* on the first side of the communicating channel 44. In other words, the communicating channel 44 extends from the first upstream side 145*a* and the second upstream side 146*a* to the second side and to the first side in the second direction. Even in this case, since the nozzle 26 is arranged at a position, in the communicating channel 44, which is sandwiched between the first upstream end 145*a* and the second upstream end 146*a*. Accordingly, it is possible to uniformize the flow of the liquid in the nozzle 26 while preventing the air bubble from remaining therein, and to suppress the occurrence of unsatisfactory discharge.

<Third Modification>

Figure 5:
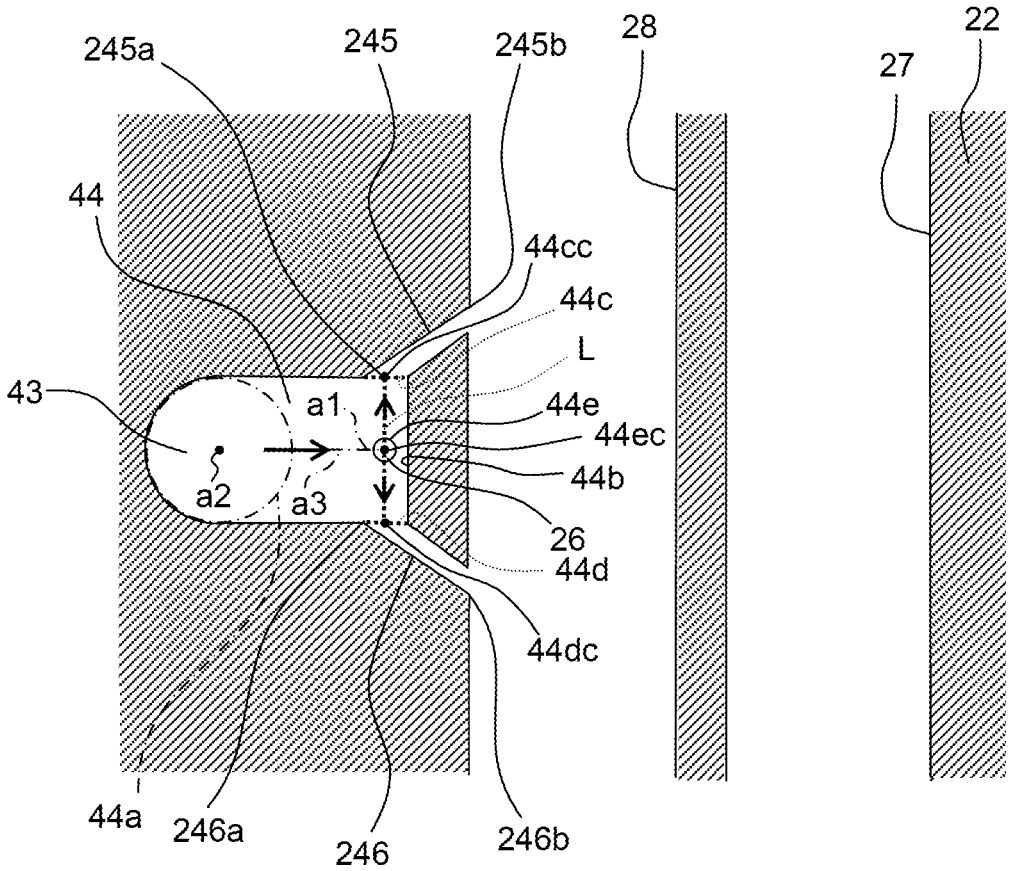
FIG. 5 is a partial cross-sectional view of a liquid discharging head according to a third modification.
Figure 5:
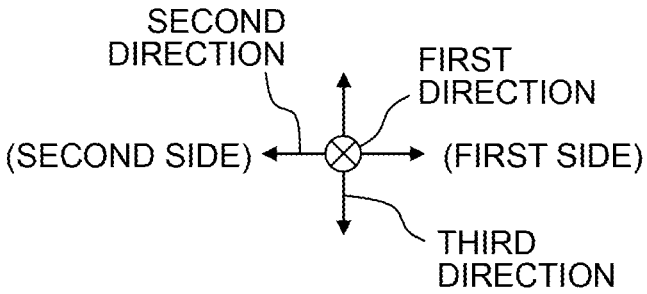

In a head 10 according to a third modification, as depicted in FIG. 5, each of a first return channel 245 and a second return channel 246 extend linearly. Note that other than this point, the first return channel 245 and the second return channel 246 are similar to the first return channel 45 and the second return channel 46, respectively.

For example, each of the first and second return channels 245 and 246 is arranged to be inclined with respect to the communicating channel 44 and the return manifold 28 along a plane or surface orthogonal to the first direction. The first and second return channels 245 and 246 extend linearly and obliquely with respect to the second and third directions from first and second upstream ends 245*a*, 246*a* thereof toward first and second downstream ends 245*b*, 246*b*, respectively, so that the distance in the third direction between the first and second return channels 245 and 246 is increased.

In a case that the first and second return channels 245 and 246 are bent, there is a possibility that the air bubble might be caught, for example, in a recessed corner part thereof, etc. In contrast, in a case that the first and second return channels 245 and 246 extend straight, since the air bubble flows smoothly from the communicating channel 44 through each of the first and second return channels 245 and 246 to be discharged, it is possible to suppress such a situation that the air bubble enters from the communicating channel 44 to the nozzle 26. Therefore, it is possible to suppress the unsatisfactory discharge due to the air bubble.

Note that in the first return channel 245 and the second return channel 246, the angles thereof with respect to the communicating channel 44 are same as each other. However, in the first return channel 245 and the second return channel 246, the angles thereof with respect to the return manifold 28 are different from each other. Accordingly, an angle defined by a direction in which the liquid flows in the first return channel 245 and a direction in which the liquid flows in the return manifold 28, and an angle defined by a direction in which the liquid flows in the second return channel 246 and the direction in which the liquid flows in the return manifold 28 are different from each other. Therefore, it is allowable that the shape of the first return channel 245 and the shape of the second return channel 246 may be different from each other so that the channel resistance of the first return channel 245 and the channel resistance of the second return channel 246 are same as each other.

<Other Modifications>

In the above-described embodiment and the first and second modifications, each of the first and second return channels is bent, from the upstream end thereof to the downstream end thereof, from the third direction to the second direction at 90 degrees; the angle, however, is not limited to 90 degrees. For example, the angle of bending of each of the first and second return channels may be greater than 90 degrees. In such a case, since an angle at which each of the first and second return channels is recessed becomes large, the air bubble is less likely to remain in each of the first and second return channels. Therefore, it is possible to suppress the occurrence of unsatisfactory discharge caused by the air bubble, while suppressing the increase in the size of the head 10.

In the above-described embodiment and the first and second modifications, each of the first and second return channels is bent in the second direction and the third direction; however, the shape in which each of the first and second return channels is bent is not limited to this. For example, each of the first and second return channels may be curved. In such a case, a part or all of each of the first and second return channel may be curved. With this, since any corner part which is recessed is not formed in each of the first and second return channels, the air bubble is allowed to flow smoothly and is discharged. Therefore, it is possible to reduce the occurrence of unsatisfactory discharge caused by the air bubble, while suppressing the increase in the size of the head 10.

In the above-described embodiment and each of the modifications, although the nozzle 26 has the tapered shape, the shape of the nozzle 26 is not limited to this. For example, the nozzle 26 may be cylindrical shaped such that the area of the proximal end 26*a* of the nozzle 26 is same as the area of the distal end 26*b* of the nozzle 26.

The above-described embodiment and respective modifications may be combined with each other as long as they are not mutually exclusive. For example, in the second and third modifications and the other modification(s), the third connection port may be arranged on the line segment L as in the first modification. In the third modification and the other modifications, each of the first and second return channels may be connected, in the second direction, at a location closer to the second side of the communicating channel than the first end of the communicating channel, as in the second modification.

From the above-described explanation, numerous improvements and/or other embodiments of the present disclosure will be apparent to those skilled in the art. Accordingly, the foregoing explanation should be interpreted as a mere example, and as being provided for the purpose of providing, to those skilled in the art, the best mode for carrying out the present disclosure. The configuration and/or the detailed function of the present disclosure may be substantially changed, without departing from the spirit of the present disclosure.

What is claimed is:

1. A liquid discharging head comprising:

a pressure chamber;

a descender extending from the pressure chamber in a first direction;

a communicating channel extending from the descender in a second direction crossing the first direction;

a first return channel and a second return channel connecting the communicating channel and a return manifold; and a nozzle connected to the communicating channel, wherein the first return channel and the second return channel are connected to the communicating channel at facing positions, respectively, the facing positions facing each other in a direction orthogonal to the second direction; and the nozzle is provided, in the communicating channel, at a position which is offset from an axis of the descender, and which is sandwiched between a connecting location of the first return channel to the communicating channel and a connecting location of the second return channel to the communicating channel.

2. The liquid discharging head according to claim 1, wherein the communicating channel has one end connected to the descender and the other end on an opposite side to the one end, and the first return channel and the second return channel are connected to the other end of the communicating channel.

3. The liquid discharging head according to claim 1, wherein the communicating channel has a first connection port connected to the first return channel, a second connection port connected to the second return channel, and a third connection port connected to the nozzle, and the third connection port is arranged on a line segment connecting a center of the first connection port and a center of the second connection port.

4. The liquid discharging head according to claim 3, wherein a center of the third connection port is arranged on the line segment.

5. The liquid discharging head according to claim 1, wherein channel resistance of the first return channel and channel resistance of the second return channel are same as each other.

6. The liquid discharging head according to claim 1, wherein the first return channel and the second return channel have shapes which are symmetric with respect to an axis, of the communicating channel, extending in the second direction.

7. The liquid discharging head according to claim 1, wherein each of the first return channel and the second return channel is bent in a direction orthogonal to the first direction.

8. The liquid discharging head according to claim 1, wherein each of the first return channel and the second return channel extends straight.

9. The liquid discharging head according to claim 1, wherein the nozzle has a proximal end connected to the communicating channel, and a distal end located on an opposite side to the proximal end, and the nozzle has a tapered shape in which a cross-sectional area orthogonal to an axial direction of the nozzle is reduced from the proximal end toward the distal end.

10. The liquid discharging head according to claim 1, wherein in an axial direction of the nozzle, a size of the communicating channel is same as a size of the first return channel and same as a size of the second return channel.

* * * * *